United States Patent [19]

Miyahara

[11] Patent Number: 4,813,865

[45] Date of Patent: Mar. 21, 1989

[54] FUEL GASIFYING BURNER

[75] Inventor: Kingo Miyahara, Tokyo, Japan

[73] Assignee: Dowa Co., Ltd., Tokyo, Japan

[21] Appl. No.: 146,666

[22] Filed: Jan. 21, 1988

[51] Int. Cl.[4] ..... F23D 11/04

[52] U.S. Cl. ..... 431/168; 431/210

[58] Field of Search ..... 431/168, 169, 210; 239/214.25

[56] References Cited

U.S. PATENT DOCUMENTS 4,247,282 1/1981 Miyahara ..... 431/168

4,516,931 5/1985 Miyahara ..... 431/168

FOREIGN PATENT DOCUMENTS 57-73306 5/1982 Japan .

*Primary Examiner*—Carroll B. Dority, Jr.

*Attorney, Agent, or Firm*—Pollock, Vande Sande & Priddy

[57] ABSTRACT

A fuel gasifying burner comprising a gas chamber defined between a bottom wall of a combustion cylinder and a combustion plate formed with gasified fuel blowing openings. A plurality of ventilation pipes extend through the gas chamber for communicating an air blowing chamber with an annular air ejection passage defined between the gas chamber and a fuel gasifying member rotatably arranged within the combustion cylinder. First and second mixing promotion cylinders arranged between the ventilation pipes and the gasified fuel blowing openings are spaced from each other to define therebetween a narrow and bent passage through which gasified fuel-air mixture from the fuel gasifying member flows into the gas chamber. A flat gas inflow chamber having a radially outward peripheral closed end is defined between the first mixing promotion cylinder and the bottom wall of the combustion cylinder. A deceleration ring extends from a peripheral wall of the combustion cylinder, radially inwardly toward a radially outwardly extnding wall of the second mixing promotion cylinder. The mixture from the bent passage impinges against the deceleration ring.

7 Claims, 3 Drawing Sheets

FUEL GASIFYING BURNER

BACKGROUND OF THE INVENTION

The present invention relates to a fuel gasifying burner in which gasified fuel and combustion air of gasified fuel-air mixture generated within a fuel gasifying member are agitated and mixed with each other in the course of flowing toward a gas chamber, to make the mixture uniform in concentration and, subsequently, the mixture flows under uniform pressure into the gas chamber so that the mixture can be blown uniformly through a plurality of gasified fuel blowing openings and the blown mixture can be burnt stably.

A fuel gasifying burner is known from, for example, Japanese Patent Application Laid-Open No. 57-73306, in which gasified fuel-air mixture generated within a fuel gasifying member is blown from a gas chamber through a plurality of blowing openings, and the blown mixture is burnt. In the known burner, the gasified fuel-air mixture is completely prevented from being burnt immediately at a mixture dilution chamber defined between the gas chamber and an open end of the fuel gasifying member. This makes it possible to prevent the fuel gasifying member from being burnt out. Further, flash back combustion into the gas chamber can be prevented from occurring, and high combustion noise can also be prevented from being emitted. Thus, excellent gasified fuel combustion can continue for a long period of time. The known burner will be described below in more detail with reference to FIG. 4 of the accompanying drawings.

As shown in FIG. 4, the known burner comprises a tubular combustion cylinder 1 having a bottom wall, which is disposed adjacent an air blowing chamber 2. A combustion plate 3 having formed therethrough a plurality of blowing openings 4 is arranged within the combustion cylinder 1, to define a gas chamber 5 between the combustion plate 3 and the bottom wall of the combustion cylinder 1. A fuel gasifying member 7 is rotatably arranged within the combustion chamber 1. The fuel gasifying member 7 has at its axial one end a bottom wall, and has the other axial open end which communicates with the gas chamber 5. A gasified fuel-air mixture dilution chamber 6 is defined between the gas chamber 5 and the other axial open end of the fuel gasifying member 7.

The dilution chamber 6 has a radially inward end communicating with the gas chamber 5, and communicates with the air blowing chamber 2 through a plurality of ventilation pipes 8.

In the above-described known burner, the plurality of ventilation pipes 8, which are arranged within the gas chamber 5 adjacent the fuel gasifying member 7 so as to extend through the gas chamber 5, are an obstacle to flow of the gasified fuel-air mixture. This causes a considerable difference in flow velocity between the mixture flow adjacent the ventilation pipes 8 and the mixture flow remote therefrom. As a result, flames formed by combustion of the gasified fuel-air mixture blown through the blowing openings 4 in the combustion plate 3 might sometimes be partially lifted from the blowing openings 4, or red flames might mingle with blue flames. Thus, it is difficult to stably blow and burn the gasified fuel-air mixture under constant pressure and, in addition thereto, it is difficult to well agitate and mix the gasified fuel and the combustion air with each other to continuously provide gasified fuel-air mixture uniform in concentration.

SUMMARY OF THE INVENTION

It is an object of the invention to provide a fuel gasifying burner which can make gasified fuel-air mixture uniform in concentration, and can blow the mixture at uniform blow velocity, thereby enabling the blown mixture to be burnt stably.

According to the invention, there is provided a fuel gasifying burner comprising:

a combustion cylinder having a peripheral wall and a bottom wall provided at axial one end of the peripheral wall, the bottom wall having formed therein an opening;

means cooperating with an outer end face of the bottom wall of the combustion cylinder for defining an air blowing chamber communicating with the opening in the bottom wall of the combustion cylinder;

a combustion plate having formed therethrough a plurality of gasified fuel blowing openings, the combustion plate being arranged within the combustion cylinder to define a gas chamber between the combustion plate and the bottom wall of the combustion cylinder;

a fuel gasifying member arranged within the combustion cylinder for rotation about an axis thereof, the fuel gasifying member having a peripheral wall extending about the axis of the combustion cylinder, the peripheral wall of the fuel gasifying member having axial one open end and the other axial closed end, the fuel gasifying member defining a gasified fuel-air mixture passage having an upstream end communicating with the air blowing chamber through the opening in the bottom wall of the combustion cylinder, and a downstream end communicating with the gas chamber;

means for supplying liquid fuel into combustion air blown from the air blowing chamber toward the gasified fuel-air mixture passage through the opening in the bottom wall of the combustion cylinder, to form gasified fuel-air mixture;

an annular air ejection passage defined between the gas chamber and the axial open one end of the peripheral wall of the fuel gasifying member;

a plurality of ventilation pipes arranged circumferentially about the axis of the combustion cylinder and extending through the gas chamber for communicating the air blowing chamber with the annular air ejection passage;

a first mixing promotion cylinder located radially outwardly of the ventilation pipes and radially inwardly of the gasified fuel blowing openings in the combustion plate, for directing the gasified fuel-air mixture from the gasified fuel-air mixture passage, away from the bottom wall of the combustion cylinder, the first mixing promotion cylinder cooperating with the bottom wall of the combustion cylinder to define therebetween a flat gas inflow chamber having a radially outward peripheral closed end;

a second mixing promotion cylinder located radially outwardly of the ventilation pipes and radially inwardly of the gasified fuel blowing openings in the combustion plate, the second mixing promotion cylinder having a peripheral wall extending from the combustion plate toward the bottom wall of the combustion cylinder and an extension wall extending radially outwardly from an end of the peripheral wall of the second mixing promotion cylinder adjacent the bottom wall of the combustion cylinder, for directing the gasified fuel-air mixture from the first mixing promotion cylinder, toward the bottom wall of the combustion cylinder, the second mixing promotion cylinder being spaced from the first mixing promotion cylinder to define therebetween a narrow and bent gasified fuel-air mixture passage; and an annular gasified fuel-air mixture deceleration ring extending from an inner peripheral surface of the peripheral wall of the combustion cylinder, radially inwardly toward the extension wall of the second mixing promotion cylinder in confronted, but spaced relation thereto.

DETAILED DESCRIPTION

The invention will be described in detail, by way of mere example, with reference to FIGS. 1 through 3.

Figure 1:
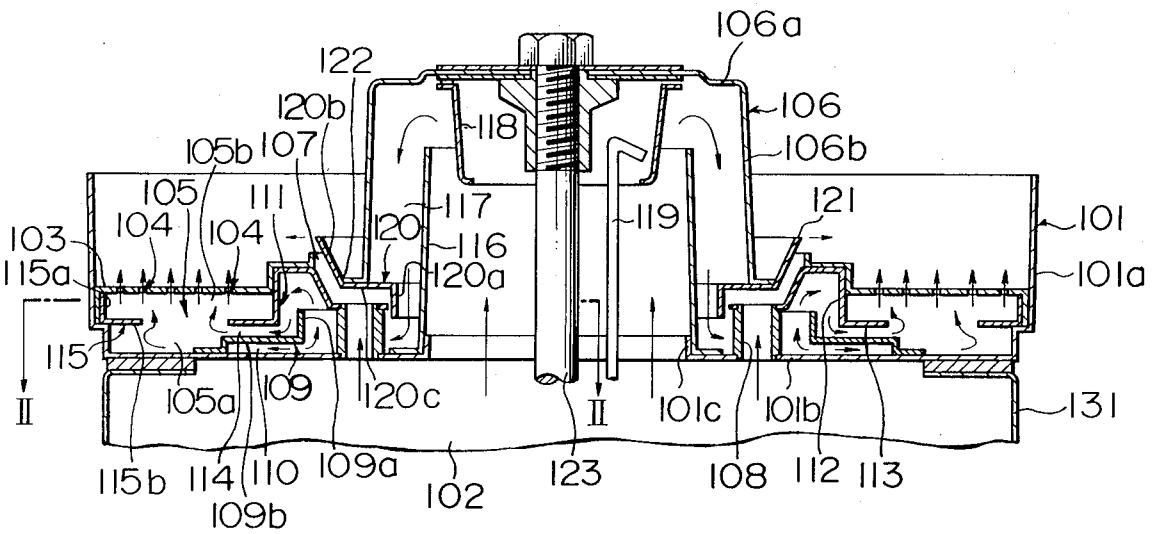
FIG. 1 is a fragmental, longitudinal cross-sectional view of a fuel gasifying burner according to a first embodiment of the invention.
Figure 2:
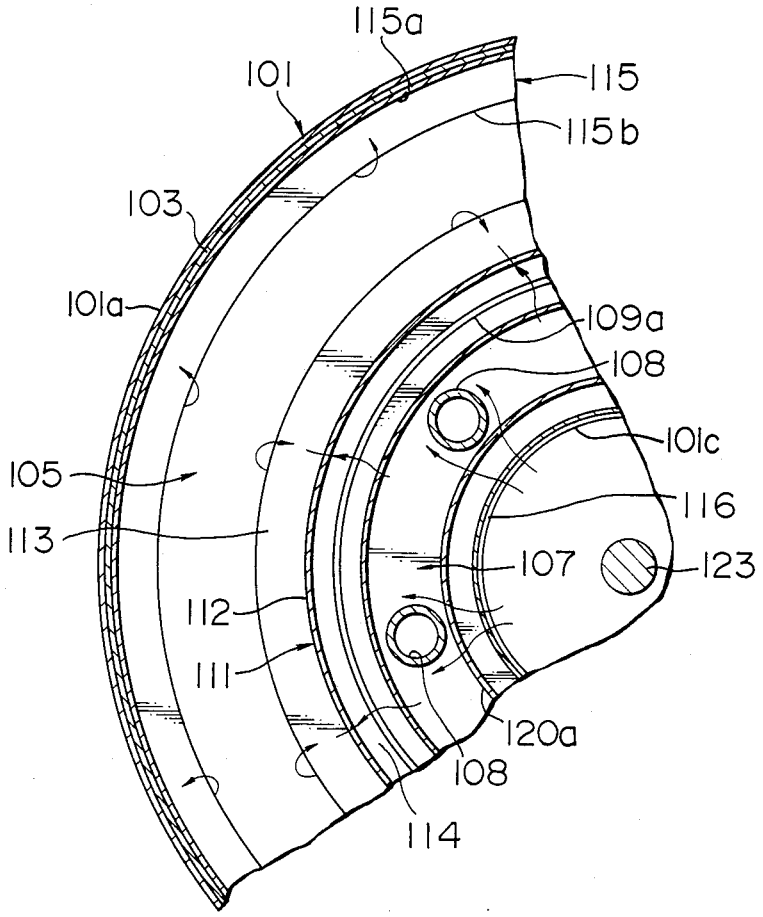
FIG. 2 is a fragmental cross-sectional view taken along the line II—II in FIG. 1.

Referring first to FIGS. 1 and 2, there is illustrated a fuel gasifying burner according to a first embodiment of the invention. The fuel gasifying burner comprises a combustion cylinder 101 which has a peripheral wall 101*a* and a bottom wall 101*b* at axial one end of the peripheral wall 101*a*. The peripheral wall 101*a* is open at the other axial end. The bottom wall 101*b* is formed therein with a central opening 101*c*. A cylindrical member 131 is fixedly mounted to an outer end face of the bottom wall 101*b* to define an air blowing chamber 102.

An annular combustion plate 103 provided therethrough with a plurality of gasified fuel blowing openings 104 is arranged within the combustion cylinder 101. The combustion plate 103 extends substantially in parallel to the bottom wall 101*b* of the combustion cylinder 101 to define therebetween a gas chamber 105.

A rotary shaft 123 extends along an axis of the combustion cylinder 101 and through the central opening 101*c* in the bottom wall 101*b* of the combustion cylinder 101. The rotary shaft 123 has its forward end projecting axially outwardly from the other axial open end of the combustion cylinder 101.

A fuel gasifying member 106 is arranged within the combustion cylinder 101, and is mounted on the rotary shaft 123 for rotation therewith. The fuel gasifying member 106 has a bottom wall 106*a* fixedly mounted to the forward end of the rotary shaft 123, and a peripheral wall 106*b* extending from the bottom wall 106*a* toward the bottom wall 101*b* of the combustion cylinder 101. The peripheral wall 106*b* has an open free end which communicates with the gas chamber 105.

An annular air ejection passage 107 is defined between the gas chamber 105 and the free end portion of the peripheral wall 106*b* of the fuel gasifying member 106, subsequently to be described in detail. The annular air ejection passage 107 communicates with the air blowing chamber 102 through a plurality of ventilation pipes 108. The ventilation pipes 108 extend through the gas chamber 105 and are arranged in circumferentially equidistantly spaced relation about the axis of the combustion cylinder 101.

A first mixing promotion cylinder 109 is arranged radially outwardly of the plurality of ventilation pipes 108 and radially inwardly of the gas blowing openings 104, for directing gasified fuel-air mixture away from the bottom wall 101*b* of the combustion cylinder 101. The first mixing promotion cylinder 109 has a peripheral wall 109*a* and an extension wall 109*b* extending in an integral manner radially outwardly from an end of the peripheral wall 109*b* adjacent the bottom wall 101*b* of the combustion cylinder 101. The extension wall 109*b* cooperates with the bottom wall 101*b* to define therebetween a flat gas inflow chamber 110 having its radially outward peripheral end which is closed.

A second mixing promotion cylinder 111 is also arranged radially outwardly of the plurality of ventilation pipes 108 and radially inwardly of the gas blowing openings 104, for directing the gasified fuel-air mixture from the first mixing promotion cylinder 109, toward the bottom wall 101*b* of the combustion cylinder 101. The second mixing promotion cylinder 111 has a peripheral wall 112 extending from the combustion plate 103 toward the bottom wall 101*b* of the combustion cylinder 101, and an extension wall 113 extending in an integral manner radially outwardly from an end of the peripheral wall 112 adjacent the bottom wall 101*b*. The peripheral wall 112 of the second promotion cylinder 111 is spaced radially outwardly from the peripheral wall 109*a* of the first mixing promotion cylinder 111. The first and second mixing promotion cylinders 109 and 111 cooperate with each other to define therebetween a gasified fuel-air mixture passage 114 which is bent and is narrow.

An annular gasified fuel-air mixture deceleration ring 115 is arranged within the combustion cylinder 101. The deceleration ring 115 has a peripheral wall 115*a* fixedly mounted to the peripheral wall 101*a* of the combustion cylinder 101, and an extension wall 115*b* extending radially inwardly from an end of the peripheral wall 115*a* adjacent the bottom wall 101*b* of the combustion cylinder 101. The extension wall 115*b* of the deceleration ring 115 is confronted with, but spaced from the extension wall 113 of the second mixing promotion cylinder 111. The extension walls 115*b* and 113 cooperate with each other to divide the gas chamber 105 into first and second chamber sections 105*a* and 105*b* which communicate with each other and which are arranged along the axis of the combustion cylinder 101.

As will be described later, gasified fuel-air mixture is reduced in flow velocity and in gas pressure during passing through the bent passage 114, while gasified fuel and combustion air of the mixture are agitated and mixed with each other within the bent passage 114. The gasified fuel-air mixture flows into the first chamber section 115*a* of the gas chamber 105 and impinges against the deceleration ring 115 so that the gasified fuel-air mixture is agitated by the deceleration ring 115. By the agitation due to the deceleration ring 115, the gasified fuel and the combustion air of the mixture are further agitated and mixed with each other so that the mixture is made uniform in concentration and is further reduced in flow velocity and in gas pressure. Then, the gasified fuel-air mixture flows into the second chamber section 105*b* of the gas chamber 105 through an annular opening between the extension wall 113 of the second mixing promotion cylinder 111 and the extension wall 115*b* of the deceleration ring 115.

An air supply duct 116 is fixedly mounted to the bottom wall 101*b* of the combustion cylinder 101 and surrounds the central opening 101c in the bottom wall 101b. The air supply duct 116 extends from the bottom wall 101b into the fuel gasifying member 106 to define therebetween a gasified fuel-air mixture passage 117 which has an upstream end in communication with the air blowing chamber 102 through the central opening 101c, and a downstream end in communication with the gas chamber 105.

A fuel diffusing member 118, which has a frustoconical shape converging toward the central opening 101c in the bottom wall 101b, is fixedly mounted to the bottom wall 106a of the fuel gasifying member 106 and extends into the open free end of the air supply duct 116. A fuel supply line 119 extends into the fuel diffusing member 118 through the central opening 101c and the air supply duct 116, and has a forward end which is directed toward an inner peripheral surface of the fuel diffusing member 118 in close relation thereto.

An annular gasified fuel-air mixing plate 120 is fixedly mounted to the other axial open end of the peripheral wall 106b of the fuel gasifying member 106. The annular mixing plate 120 has a cylindrical wall 120a located between the ventilation pipes 108 and the air supply duct 116, a frustoconical wall 120b, and an annular radial wall 120c extending between the walls 120a and 120b. The frustoconical wall 120b has a free end formed into a liquid fuel scattering end 121. The frustoconical wall 120b is spaced radially outwardly from the peripheral wall 106b of the fuel gasifying member 106 to define therebetween a liquid fuel scattering gap 122. The above-mentioned annular air ejection passage 107 is defined between the mixing plate 120 and the gas chamber 105.

It will be understood from the foregoing that the annular air ejection passage 107 is a rotational gap for the fuel gasifying member 106, and that the combustion air is permitted to always flow from the air blowing chamber 102 through the ventilation pipes 108 and the air ejection passage 107 to prevent the other axial end portion of the peripheral wall 106b of the fuel gasifying member 106 and the combustion plate 103 from being burnt out.

The operation of the fuel gasifying burner constructed as mentioned above will be described below.

As the burner is started, the fuel gasifying member 106 is rotated at high speed by the rotary shaft 123, and combustion air is blown from the air blowing chamber 102 into the air supply duct 116 through the central opening 101c in the bottom wall 101b of the combustion cylinder 101. The combustion air flows through the passage 117, and through an annular gap between the cylindrical wall 120a of the mixing plate 120 and the air supply duct 116. The combustion air passes through the spaces between the ventilation pipes 108 and flows into the bent passage 114. The combustion air flowing out of the bent passage 114 enters the first chamber section 105a of the gas chamber 105. The combustion air impinges against the deceleration ring 115 and is agitated thereby. The combustion air is reduced in flow velocity by the deceleration ring 115 and flows under uniform pressure into the second chamber section 105b of the gas chamber 105 through the annular opening between the extension wall 115b of the deceleration ring 115 and the extension wall 113 of the second mixing promotion cylinder 111. Finally, the combustion air is blown at uniform velocity through the gasified fuel blowing openings 104 in the combustion plate 103.

With the combustion air flowing in the manner as described above, liquid fuel is supplied through the fuel supply line 119. Then, the fuel is diffused and atomized or pulverized by the fuel diffusing member 118 and is further atomized by the blowing action of the combustion air blown from the air blowing chamber 102. The atomized fuel is carried by the combustion air flow described above and is blown from the open free end of the gasifying member 106 into the combustion cylinder 1 so as to be ignited and burnt in a liquid state to generate flames.

By the flames due to the liquid state combustion of the fuel, the entire fuel gasifying member 106 is heated. Thus, after this, the fuel supplied from the fuel supply line 119 into the heated fuel gasifying member 106 is evaporated and gasified thereby. The gasified fuel is agitated and mixed with the combustion air to form gasified fuel-air mixture. The gasified fuel-air mixture flows into the first chamber section 105a of the gas chamber 105 through the bent passage 114. The gasified fuel-air mixture is accumulated in the second chamber section 105b of the gas chamber 105 and is blown into the combustion cylinder 101 through the gasified fuel blowing openings 104. The gasified fuel-air mixture blown into the combustion cylinder 101 is burnt therewithin.

The gasified fuel-air mixture flowing out of the annular space between the air supply duct 116 and the cylindrical wall 120a of the mixing plate 120 and flowing toward the gas chamber 105 is not uniform in flow velocity because of presence of the plurality of ventilation pipes 108. In other words, the mixture flow passing through locations close to the ventilation pipes 108 is different in velocity from mixture flow passing through locations remote from the ventilation pipes 108. Because of the provision of the narrow and bent passage 114, however, the gasified fuel-air mixture passing at non-uniform flow velocity between the adjacent ventilation pipes 108 impinges first against the first mixing promotion cylinder 109. A part of the mixture then enters the flat gas inflow chamber 110 having the outer peripheral closed end, and is overflown out of the gas inflow chamber 110. Subsequently, the mixture impinges against the peripheral wall 112 of the second mixing promotion cylinder 111 and flows into the first chamber section 105a of the gas chamber 105 through the narrow and bent passage 114 toward the peripheral wall 101a of the combustion cylinder 101. A part of the mixture flows along the deceleration ring 115 while impinging against the peripheral wall 101a of the combustion cylinder 101, and enters the second chamber section 105b of the gas chamber 105. The remaining mixture passes around the peripheral edge of the extension wall 113 of the second mixing promotion cylinder 111, and enters the second chamber section 105b of the gas chamber 105.

As described above, even if the gasified fuel-air mixture passes at non-uniform velocity between the plurality of ventilation pipes 108, the gasified fuel and the combustion air of the mixture are agitated and mixed with each other due to the above-mentioned repeated impingement, so that the mixture is made uniform in concentration. In addition thereto, the mixture is considerably reduced in flow velocity and in gas pressure, so that the mixture is made substantially uniform in flow velocity and in gas pressure. The mixture having substantially uniform flow velocity and gas pressure enters the second chamber section 105b of the gas chamber 105 and is accumulated therein. Subsequently, the gasified fuel-air mixture is blown at substantially uniform velocity through the blowing openings 104 and is burnt to form flames. Thus, the flames can be prevented from being lifted partially, making it possible to always maintain stable blue flame combustion.

Figure 3:
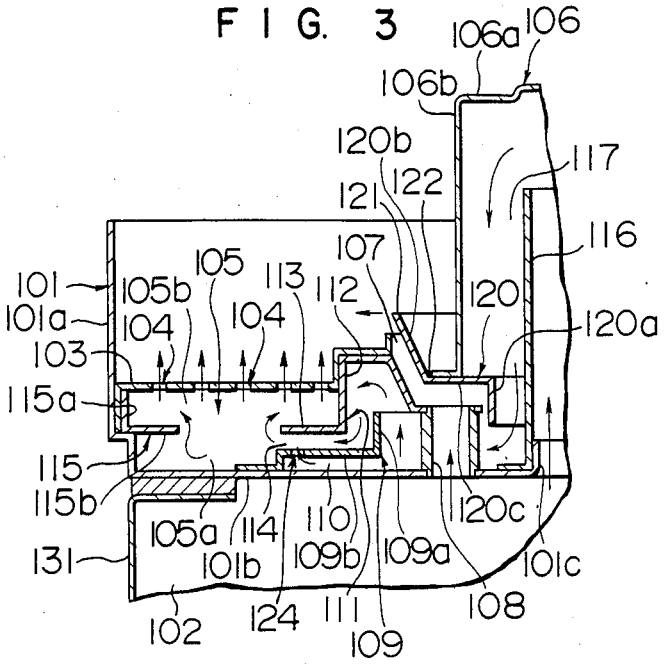
FIG. 3 is a fragmental, longitudinal cross-sectional view showing a second embodiment of the invention.
Figure 4:
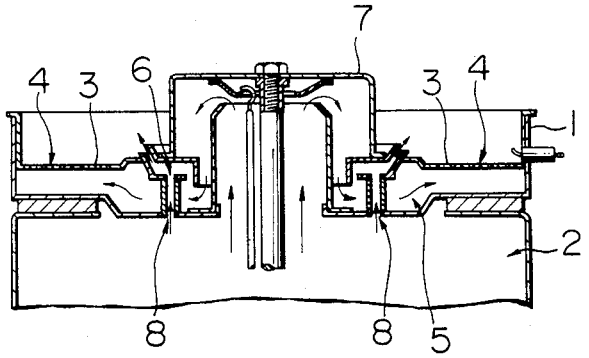
FIG. 4 PRIOR ART
FIG. 4 is a fragmental, longitudinal cross-sectional view of a fuel gasifying burner of the prior art.

Referring to FIG. 3, there is illustrated a fuel gasifying burner according to a second embodiment of the invention. In FIG. 3, like or similar reference numerals are used to designate parts and components like or similar to those shown in FIGS. 1 and 2, and the description of such like or similar parts and components will therefore be omitted to avoid duplication. In the second embodiment illustrated in FIG. 3, a plurality of circumferentially spaced ejection openings 124 are formed in the extension wall **109*b* of the first mixing promotion cylinder 109, to communicate the flat gas inflow chamber 110 with the bent gasified fuel-air mixture passage 114. With the arrangement of the second embodiment, the gasified fuel-air mixture entering the flat gas inflow chamber 110 from the fuel gasifying member 106 through the spaces between the plurality of ventilation pipes 108 is ejected into the bent passage 114 through the ejection openings 124 so as to cross the bent passage 114. The mixture ejected through the ejection openings 124 impinges against the gasified fuel-air mixture flowing through the bent passage 114. By agitating and mixing action due to the impingement, the gasified fuel-air mixture is made further uniform in concentration and is further reduced in flow velocity and in gas pressure. Thus, the gasified fuel-air mixture having uniform pressure enters the gas chamber 105** so that the gasified fuel combustion can be effected in a more stable manner.

As described above, the fuel gasifying burner according to the invention comprises the first mixing promotion cylinder 109 arranged radially outwardly of the ventilation pipes 108 and radially inwardly of the gasified fuel blowing openings 104 in the combustion plate 103, for directing the gasified fuel-air mixture from the gasified fuel-air mixture passage 117, away from the bottom wall **101*b* of the combustion cylinder 101. The first mixing promotion cylinder 109 cooperates with the bottom wall 101*b* to define therebetween the flat gas inflow chamber 110 having its radially outward peripheral closed end. The second mixing promotion cylinder 111 has the peripheral wall 112 extending from the combustion plate 103 toward the bottom wall 101*b*, and the extension wall 113 extending radially outwardly from the peripheral wall 112. The second mixing promotion cylinder 111 is arranged radially outwardly of the ventilation pipes 108 and radially inwardly of the gasified fuel blowing openings 104, for directing the gasified fuel-air mixture from the first mixing promotion cylinder 109, toward the bottom wall 101*b*. The first and second mixing promotion cylinders 109 and 111 are spaced from each other to define therebetween the narrow and bent gasified fuel-air mixture passage 114. The annular deceleration ring 115 extends from the peripheral wall 101*a* of the combustion cylinder 101, radially inwardly toward the extension wall 113 of the second mixing promotion cylinder 111 in confronted, but spaced relation thereto. With the arrangement of the fuel gasifying burner, the gasified fuel and the combustion air of the mixture flowing toward the gas chamber 105 are effectively agitated and mixed with each other by the bent passage 114. In addition, the mixture having passed between the ventilation pipes 108 once enters the flat gas inflow chamber 110 in which the gasified fuel and the combustion air of the mixture are agitated and mixed with each other, and the mixture is reduced in flow velocity and in gas pressure. Thus, the gasified fuel-air mixture entering the first chamber section 105*a* of the gas chamber 105 can have substantially uniform flow velocity and gas pressure. Moreover, the gasified fuel-air mixture having entered the first chamber section 105*a* impinges against the deceleration ring 115 just before the mixture enters the second chamber section 105*b*, so that the gasified fuel and the combustion air of the mixture are further agitated and mixed with each other, and the mixture is further reduced in flow velocity and in gas pressure. Accordingly, the gasified fuel-air mixture flowing into the second chamber section 105*b* of the gas chamber 105 and accumulated therein is made uniform in pressure anywhere. Thus, the gasified fuel-air mixture can be blown at substantially uniform velocity through the gasified fuel blowing openings 104 in the combustion plate 103**, and can be burnt with stable gasified fuel combustion flames.

The arrangement of the second embodiment described above with reference to FIG. 3 is such that a part of the gasified fuel-air mixture having entered the flat gas inflow chamber 110 is ejected into the bent passage 114 through the ejection openings 124 so as to cross the bent passage 114. Thus, the gasified fuel and the combustion air of the mixture are more effectively agitated and mixed with each other, and the mixture is more effectively reduced in flow velocity and in gas pressure, so that gasified duel combustion can continue for a long period of time in a stable manner.

What is claimed is:

1. A fuel gasifying burner comprising:

a combustion cylinder having a peripheral wall and a bottom wall provided at axial one end of said peripheral wall, said bottom wall having formed therein an opening;

means cooperating with an outer end face of said bottom wall of said combustion cylinder for defining an air blowing chamber communicating with said opening in said bottom wall of said combustion cylinder;

a combustion plate having formed therethrough a plurality of gasified fuel blowing openings, said combustion plate being arranged within said combustion cylinder to define a gas chamber between said combustion plate and said bottom wall of said combustion cylinder;

a fuel gasifying member arranged within said combustion cylinder for rotation about an axis thereof, said fuel gasifying member having a peripheral wall extending about the axis of said combustion cylinder, said peripheral wall of said fuel gasifying member having axial one open end and the other axial end closed, said fuel gasifying member including means defining a gasified fuel-air mixture passage having an upstream end communicating with said air blowing chamber through said opening in said bottom wall of said combustion cylinder, and a downstream end communicating with said gas chamber;

means for supplying liquid fuel into combustion air blown from said air blowing chamber toward said gasified fuel-air mixture passage through said opening in said bottom wall of said combustion cylinder, to form gasified fuel-air mixture;

means including an annular air ejection passage defined between said gas chamber and said axial open one end of said peripheral wall of said fuel gasifying member;

a plurality of ventilation pipes arranged circumferentially about the axis of said combustion cylinder and extending through said gas chamber for communicating said air blowing chamber with said annular air ejection passage;

a first mixing promotion cylinder located radially outwardly of said ventilation pipes and radially inwardly of said gasified fuel blowing openings in said combustion plate, for directing the gasified fuel-air mixture from said gasified fuel-air mixture passage, away from said bottom wall of said combustion cylinder, said first mixing promotion cylinder cooperating with said bottom wall of said combustion cylinder to define therebetween a flat gas inflow chamber having a radially outward peripheral closed end;

a second mixing promotion cylinder located radially outwardly of said ventilation pipes and radially inwardly of said gasified fuel blowing openings in said combustion plate, said second mixing promotion cylinder including a peripheral wall extending from said combustion plate toward said bottom wall of said combustion cylinder and an extension wall extending radially outwardly from an end of said peripheral wall of said second mixing promotion cylinder adjacent said bottom wall of said combustion cylinder, for directing the gasified fuel-air mixture from said first mixing promotion cylinder, toward said bottom wall of said combustion cylinder, said second mixing promotion cylinder being spaced from said first mixing promotion cylinder to define therebetween a narrow and bent gasified fuel-air mixture passage; and an annular gasified fuel-air mixture deceleration ring extending from an inner peripheral surface of said peripheral wall of said combustion cylinder, radially inwardly toward said extension wall of said second mixing promotion cylinder in confronted, but spaced relation thereto.

2. A fuel gasifying burner as defined in claim 1, wherein said first mixing promotion cylinder is provided with a plurality of ejection openings for ejecting a part of the gasified fuel-air mixture having entered said flat gas inflow chamber, into said bent gasified fuel-air mixture passage.

3. A fuel gasifying burner as defined in claim 2, wherein said first mixing promotion cylinder has a peripheral wall spaced radially inwardly from said peripheral wall of said second mixing promotion cylinder, and an extension wall extending radially outwardly from an end of said peripheral wall of said first mixing promotion cylinder adjacent said bottom wall of said combustion cylinder, said extension wall of said first mixing promotion cylinder cooperating with said bottom wall of said combustion cylinder to define therebetween said flat gas inflow chamber which is annular in shape, said ejection openings being formed through said extension wall of said first mixing promotion cylinder.

4. A fuel gasifying burner as defined in claim 3, wherein said ejection openings are arranged in circumferentially spaced relation to each other about the axis of said combustion cylinder.

5. A fuel gasifying burner as defined in claim 1, including a tubular fuel diffusing member arranged within said fuel gasifying member and about the axis of said combustion cylinder, said means for supplying liquid fuel comprising a fuel supply line extending from said air blowing chamber into said tubular fuel diffusing member through said opening in said bottom wall of said combustion cylinder.

6. A fuel gasifying burner as defined in claim 5, wherein said fuel supply line has its free end directed toward a wall of said tubular fuel diffusing member.

7. A fuel gasifying burner as defined in claim 5, including an air supply duct arranged about said opening in said bottom wall of said combustion cylinder and extending from said bottom wall of said combustion cylinder into said fuel gasifying member, said air supply duct cooperating with said fuel gasifying member to define therebetween said gasified fuel-air mixture passage, said tubular fuel diffusing member extending from the other axial closed end of said fuel gasifying member into said air supply duct.

* * * * *